US005664876A

United States Patent [19]

Vafai et al.

[11] Patent Number: 5,664,876

[45] Date of Patent: Sep. 9, 1997

[54] TAMPER RESISTANT COVER FOR TRACK LIGHTING

[75] Inventors: James Vafai, Barrington; Sam Martorano, DesPlaines, both of Ill.

[73] Assignee: Cooper Industries, Inc., Houston, Tex.

[21] Appl. No.: 661,745

[22] Filed: Jun. 11, 1996

[51] Int. Cl.[6] ..... F21V 21/34; F21S 1/02

[52] U.S. Cl. ..... 362/249; 362/147; 362/404; 439/113; 439/110

[58] Field of Search ..... 362/226, 249, 362/250, 239, 147, 145, 404, 237; 439/110, 116, 119, 113

[56] References Cited

U.S. PATENT DOCUMENTS 3,246,074 4/1966 Neumann et al. ..... 439/110
4,338,653 7/1982 Marrero .
5,045,981 9/1991 Nagano .
5,128,847 7/1992 Lin et al. ..... 362/239
5,217,298 6/1993 Jackson et al. ..... 362/226
5,345,729 9/1994 Prahst et al. .

*Primary Examiner*—Stephen F. Husar
*Assistant Examiner*—Thomas M. Sember
*Attorney, Agent, or Firm*—Burns, Doane, Swecker & Mathis,L.L.P.

[57] ABSTRACT

A track lighting assembly includes a track mounted to a support, the track carrying electrical conductor strips and including a slot for receiving lampholders. Tamper-proof cover members are mounted to the track to cover the portions of the slot disposed between lampholders in order to prevent additional lampholders from being installed. The cover members are attached to a back wall of the track by screws, so that the cover members can be removed only when the track is detached from the support.

15 Claims, 1 Drawing Sheet

TAMPER RESISTANT COVER FOR TRACK LIGHTING

BACKGROUND OF THE INVENTION

The invention relates to track lighting systems and, in particular, to a track cover for such systems.

A track lighting system typically comprises an elongated track which is mounted to a support, such as a ceiling or wall. The track presents an elongated slot for receiving the adapter ends of lampholders. Electrical conductor strips are mounted within the track and arranged to be contacted by terminals disposed on the adapters for supplying power to the lampholders.

A problem can develop during the use of such track lighting systems when a user, despite warnings to the contrary, attempts to add more lampholders than that for which the system is designed. That is, a track circuit is capable of safely accommodating only a certain number of lampholders. However, since additional lampholders can be separately purchased, and since the elongated slot of the track is long enough to physically receive additional lampholders, it is possible for a user to overload a circuit with additional lampholders, thereby creating a fire hazard. This can be done even when the spaces between the original lampholders are occupied by a cover member, because the user simply removes the cover when adding lampholders.

It has, therefore, been the practice for manufacturers of track lighting systems to offer multi-circuit track systems to help guard against an overloaded condition. This practice, however, increases the cost of the system and is often unnecessary because not all users tend to add lampholders.

SUMMARY OF THE INVENTION

The present invention relates to a track lighting apparatus comprising a track which includes back, side, and front walls. The back wall is adapted to be connected to a support, such as a ceiling or wall. The front wall includes an elongated slot for receiving lampholders. The track includes electrical conductors engageable by terminals on the lampholders for energizing the lampholders. A cover structure extends along the slot and defines openings in which lampholders can be installed. The cover structure is removable from the track only with the track detached with respect to the support.

Preferably, a fastening structure is provided for attaching the cover structure to the track, the fastening structure being accessible solely from behind the track.

The fastening structure preferably includes screws passing through the back wall of the track and threadedly connected to the cover structure. The screws could be self-tapping screws and/or could have tamper-proof heads.

The cover structure preferably includes a front portion extending across the slot, and a rear portion including a rearwardly open groove in which the screws are threadedly connected.

The cover structure preferably comprises a plurality of cover members which are spaced apart to define the openings therebetween.

BRIEF DESCRIPTION OF THE DRAWING

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figure 1:
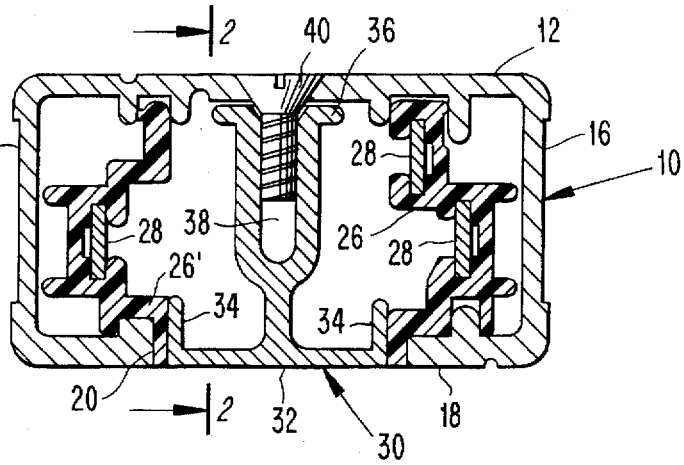
FIG. 1 is a cross-sectional view taken through a track assembly according to the present invention.
Figure 2:
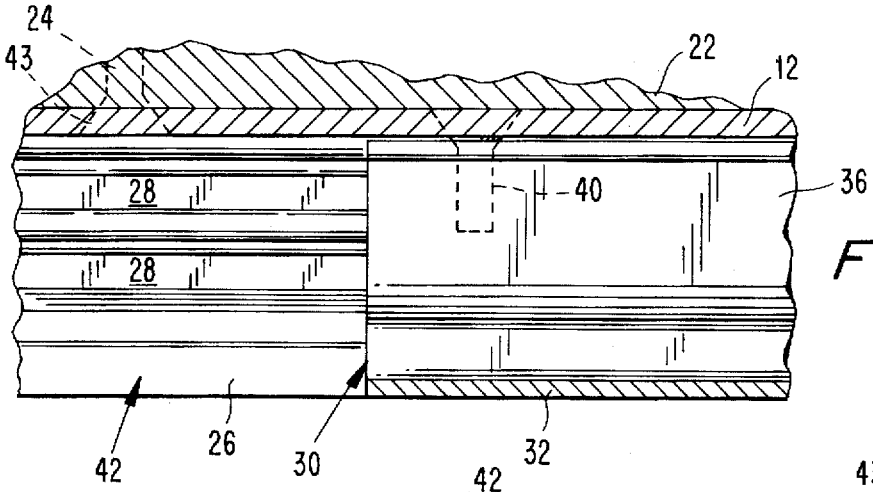
FIG. 2 is a longitudinal sectional view taken along the line 2—2 in FIG. 1.
Figure 3:
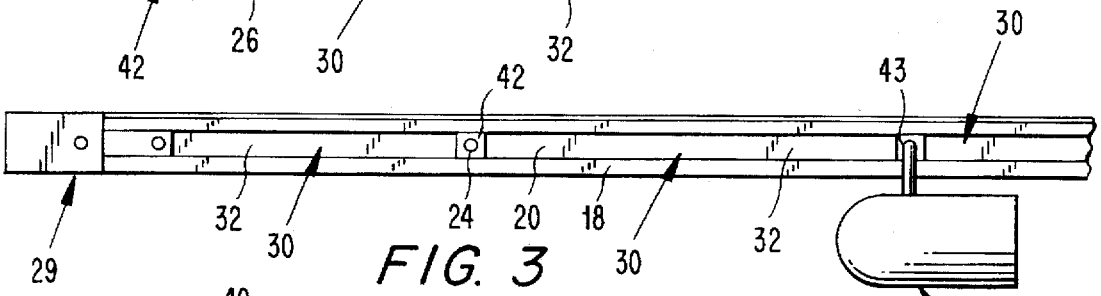
FIG. 3 is a plan view of the track assembly mounted on a support, with a lampholder mounted in the track assembly.

Depicted in FIGS. 1–3 is a one-circuit track assembly for a track lighting installation which comprises a track 10 having a back wall 12, two side walls 14, 16, and a front wall 18. The front wall includes a longitudinal slot 20. The back wall 12 is attached to a support 22, such as a ceiling or wall, by screws 24 (see FIG. 2).

Disposed within the track are two conventional conductor carriers 26, 26' formed of an electrically insulative material, such as plastic. Mounted in each of the carriers is at least one electrical conductor strip 28 connected to a live-end adapter 29 disposed at one end of the track.

Mounted to the track 10 are cover members 30 (three cover members 30 shown in FIG. 3). Each cover member 30 includes a front portion 32 extending across the slot 20. Opposite edges 34 of each cover member project rearwardly and bear against portions of the carriers 26, 26'.

A rear portion 36 of each cover member 30 forms a rearwardly open groove 38 extending the full length of the cover member.

Figure 5:
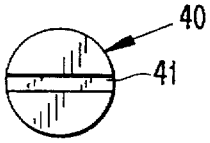
FIG. 5 is an end view of one type of screw that can be used to mount the track assembly.
Figure 6:
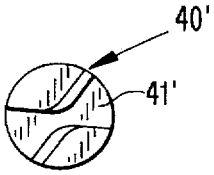
FIG. 6 is an end view of another type of screw that can be used to mount the track assembly.

Extending forwardly through pre-drilled holes in the back wall 12 are screws 40 which are received in the groove 38 to attach a respective cover member 30 to the track 10. The cover member 30 and track 10 can be formed of any suitable material but preferably are formed of extruded aluminum, and the screws 40 include self-tapping threads. Thus, no holes need to be pre-drilled in the cover member 30. The screws 40 could have a head with a conventional two-wall slot 41 shown in FIG. 5 which can be rotated in either direction by a standard screwdriver, or conventional tamper-proof screws 40' could be used having a had with a one-way slot 41' requiring that a special tool be used to loosen the screw.

The cover members 30 are spaced longitudinally apart to form openings 42 therebetween for receiving the mounting adapters 43 of conventional lampholders 44 (one lampholder 44 depicted in FIG. 3). Each opening 42 preferably has a dimension in the longitudinal direction of the track which permits no more than one lampholder 44 to be mounted therein.

The openings 42 correspond to the locations of pre-drilled holes 43 in the back wall 12 of the track 10 to provide an installer with access for attaching the screws 24 to the support 22.

The track 10 is attached to the support 22 after the covers 30 have been mounted on the track 10. It will be appreciated that since the fastening screws 40 are accessible only from the back of the track 10, the cover can only be removed from the track when the track 10 is detached with respect to the support 22. Accordingly, the cover is, in effect, tamper-proof in that it inhibits a user from attempting to install additional lampholders. Consequently, there is no need to provide extra circuits in a track installation solely as a safety measure against electrical overloading caused by the installation of too many lampholders. Rather, additional track lengths can be installed on a given circuit to accommodate a predetermined number of lampholders 44. This reduces the cost of track installation and system.

Figure 4:
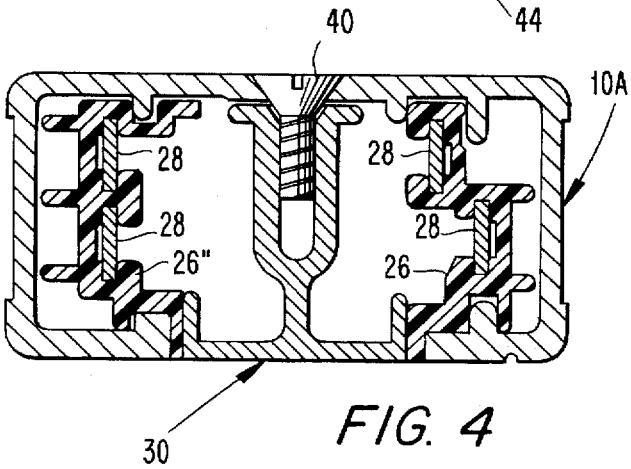
FIG. 4 is a view similar to FIG. 1 of another embodiment of the invention.

Depicted in FIG. 4 is the cover 30 mounted in a two-circuit track assembly. It will be appreciated that as many circuits as desired can be provided to accommodate a predetermined number of lampholders.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. Track lighting apparatus comprising:

a track including back, side and front walls, the back wall adapted to be connected to a support, and the front wall including an elongated slot for receiving lampholders, the track including electrical conductors engageable by terminals on the lampholders for energizing the lampholders, and a cover structure extending along the slot and defining openings in which the lampholders can be installed, the cover structure being removable from the track only with the track detached with respect to the support.

2. The apparatus according to claim 1, further including a fastening structure attaching the cover structure to the track, the fastening structure being accessible solely from behind the track.

3. The apparatus according to claim 2, wherein the fastening structure includes screws passing through the back wall and threadedly connected to the cover structure.

4. The apparatus according to claim 3, wherein the cover structure includes a front portion extending across the slot, and a rear portion including a rearwardly open groove, the screws being threadedly connected in the groove.

5. The apparatus according to claim 4, wherein the screws have self-tapping threads.

6. The apparatus according to claim 2, wherein the screws have tamper-proof heads.

7. The apparatus according to claim 1, wherein the cover structure comprises a plurality of cover members, the cover members being spaced apart to define the openings therebetween.

8. A track lighting installation comprising:

a track including back, side, and front walls, the back wall connected to a support, the front wall including an elongated slot, a plurality of electrical conductors disposed within the track;

a cover structure extending along the slot and defining openings, the cover structure being removable from the track only with the track detached with respect to the support; and lampholders mounted in respective ones of the openings, the lampholders including terminals contacting the electrical conductors.

9. The installation according to claim 8, further including a fastening structure attaching the cover structure to the track, the fastening structure being accessible solely from behind the track.

10. The installation according to claim 9, wherein the fastening structure includes screws passing through the back wall and threadedly connected to the cover structure.

11. The installation according to claim 10, wherein the cover structure includes a front portion extending across the slot, and a rear portion including a rearwardly open groove, the screws being threadedly connected in the groove.

12. The installation according to claim 11, wherein the screws have self-tapping threads.

13. The apparatus according to claim 10, wherein the screws have tamper-proof heads.

14. The installation according to claim 8, wherein the cover structure comprises a plurality of cover members, the cover members being spaced apart to define the openings therebetween.

15. The installation according to claim 8, wherein the track is mounted to the support by screws accessible through respective ones of the openings.

* * * * *